US008734131B2

(12) United States Patent
McCrone et al.

(10) Patent No.: US 8,734,131 B2
(45) Date of Patent: May 27, 2014

(54) PUMP

(75) Inventors: James Edward McCrone, Cambridgeshire (GB); Justin Rorke Buckland, Cambridgeshire (GB); David Mark Blakey, Hertfordshire (GB)

(73) Assignee: The Technology Partnership Plc, Herts (GB)

( * ) Notice: Subject to any disclaimer, the term of this patent is extended or adjusted under 35 U.S.C. 154(b) by 669 days.

(21) Appl. No.: 12/922,589

(22) PCT Filed: Mar. 13, 2009

(86) PCT No.: PCT/GB2009/050245

§ 371 (c)(1),
(2), (4) Date: Dec. 3, 2010

(87) PCT Pub. No.: WO2009/112866

PCT Pub. Date: Sep. 17, 2009

(65) Prior Publication Data

US 2011/0081267 A1 Apr. 7, 2011

(30) Foreign Application Priority Data

Mar. 14, 2008 (GB) ..... 0804739.1

(51) Int. Cl.
*F04B 17/03* (2006.01)

(52) U.S. Cl.
USPC ..... 417/413.1

(58) Field of Classification Search
USPC ..... 417/413.1, 413.2
See application file for complete search history.

(56) References Cited

U.S. PATENT DOCUMENTS

2005/0219288 A1 10/2005 Vogeley et al.
2007/0035213 A1 * 2/2007 Nakajima ..... 310/348

FOREIGN PATENT DOCUMENTS

| | | | |
|---|---|---|---|
| DE | 4422743 | A1 | 1/1996 |
| DE | 4422743 | A1 * | 1/1996 |
| RU | 2008147087 | | 6/2010 |
| WO | WO-94/19609 | A1 | 9/1994 |
| WO | WO-2006/111775 | A1 | 10/2006 |
| WO | WO 2006111775 | A1 * | 10/2006 |

* cited by examiner

*Primary Examiner* — Charles Freay
*Assistant Examiner* — Philip Stimpert
(74) *Attorney, Agent, or Firm* — Tarolli, Sundheim, Covell & Tummino LLP

(57) ABSTRACT

A fluid pump comprising a chamber which, in use, contains a fluid to be pumped, the chamber including a main cavity having a substantially cylindrical shape bounded by first and second end walls and a side wall and a secondary cavity extending radially outwards of the main cavity, one or more actuators which, in use, cause oscillatory motion of the first end wall in a direction substantially perpendicular to the plane of the first end wall, and whereby, in use, the axial oscillations of the end walls drive radial oscillations of the fluid pressure in the main cavity, and wherein the secondary cavity spaces the side wall from the first end wall such that the first end wall can move relative to the side wall when the actuator is activated.

23 Claims, 6 Drawing Sheets

PUMP

FIELD OF THE INVENTION

This invention relates to a pump for fluid and, in particular to a pump in which the pumping cavity is closely a disc-shaped cylindrical cavity, having closely-circular end walls. The design of such a pump is disclosed in WO2006/111775.

BACKGROUND OF THE INVENTION

In such a pump one or both end walls are driven into oscillating displacement in a direction substantially perpendicular to the plane of the end wall by an actuator. Where an end wall is so driven, that end-wall surface may, but need not, be itself formed as an element of a composite vibration actuator such as a piezoelectric unimorph or bimorph. Alternatively, the end wall may be formed as a passive material layer driven into oscillation by a separate actuator in force-transmitting relation (e.g. mechanical contact, magnetic or electrostatic) with it.

It is preferable to match the spatial profile of the motion of the driven end wall(s) to the spatial profile of the pressure oscillation in the cavity, a condition described herein as mode-matching. Mode-matching ensures that the work done by the actuator on the fluid in the cavity adds constructively across the driven end-wall surface, enhancing the amplitude of the pressure oscillation in the cavity and delivering high pump efficiency. In a pump which is not mode-matched there may be areas of the end-wall surface in which the work being done by the end-wall on the fluid reduces rather than enhances the amplitude of the pressure oscillation in the fluid within the cavity: the useful work done by the actuator on the fluid is reduced and the pump becomes less efficient.

This problem is demonstrated in the prior art by FIG. 3 of WO2006/111775. FIG. 3A of WO2006/111775 shows a pump in which one end-wall 12 is formed by the lower surface of disc 17 and is excited into vibrational motion by a piezoelectric actuator formed by disc 17 and piezoelectric disc 20. Together, disc 17 and piezoelectric disc 20 form a composite bending-mode actuator whose vibration excites radially-symmetric pressure waves in the fluid within the cavity 11. The amplitude of motion of end-wall 12 is a maximum at the centre of the cavity and a minimum at its edge. A pump incorporating such a composite actuator is relatively simple to construct, as the actuator may be rigidly clamped to the cavity around its perimeter where the amplitude of motion of the actuator is close to zero. However in many practical designs using conventional solid materials for construction of the curved side-walls of the cavity the acoustic impedance of those side-walls is greater than that of the working fluid and consequently the pressure oscillation in the fluid within the cavity will have an antinode at the end-wall. Since, at this location, the side-wall as shown in FIG. 3 of WO2006/111775 has a node, such an arrangement cannot deliver mode-matching that is effective across the full surface area of the end-walls. Indeed, the failure of mode-matching occurs principally at the outer radii of the end-walls, so a substantial area fraction of the end walls and working fluid volume are not vibrationally mode-matched.

FIG. 3B of WO2006/111775 shows a preferable arrangement in which the amplitude of motion of the actuator and therefore of the end-wall 12 approximates a Bessel function and has an antinode at the cavity perimeter. In this case, the driven end wall and the pressure oscillation in the fluid within the cavity are mode-matched, and the efficiency of the pump is improved. However, it is not obvious how such a pump may be constructed, as the actuator must have an antinode of vibration at the side-wall, to which it might normally be mounted.

Two further problems of the prior art are illustrated by FIG. 1 of WO2006/111775, which shows a pump driven by a simple unimorph actuator. The actuator consists of a piezoelectric disc attached to a second disc. If such an actuator is clamped at the cavity perimeter its lowest order mode will be as shown schematically in FIG. 3A.

There are two limitations to this design. Firstly, the thickness and diameter of the piezoelectric disc are determined by the need to achieve the required frequency of vibration and mode-shape in the actuator, effectively fixing the volume of piezoelectric material that may be used. As there is a limit to the power that may be delivered efficiently per unit volume of piezoelectric material, this limitation on piezoelectric disc volume puts a limit on the useful power output of the actuator. Secondly the piezoelectric disc is subject to high strain at its centre, where the amplitude of motion of the actuator and its radius of curvature are highest. It is known that high strains can lead to the degradation of piezoelectric material through its depolarisation, thereby reducing the amplitude of motion of the actuator and thus limiting actuator lifetime. Such high strain at the centre of the actuator may also lead to fatigue of the glue layer between the piezoelectric disc and the second disc if the two are joined by gluing, again leading to reduced actuator lifetime.

SUMMARY OF THE INVENTION

The present invention aims to overcome one or more of the above identified problems.

According to the invention, there is provided a fluid pump comprising:

a chamber which, in use, contains a fluid to be pumped, the chamber including a main cavity having a substantially cylindrical shape bounded by first and second end walls and a side wall and a secondary cavity extending radially outwards of the main cavity;

one or more actuators which, in use, cause oscillatory motion of the first end wall in a direction substantially perpendicular to the plane of the first end wall; and whereby, in use, the axial oscillations of the end walls drive radial oscillations of the fluid pressure in the main cavity; and wherein the secondary cavity spaces the side wall from the first end wall such that the first end wall can move relative to the side wall when the actuator is activated.

The secondary cavity may space the side wall from the first end wall such that the first end wall can move independently of the side wall when the actuator is activated.

The present invention overcomes the challenge of positioning an antinode of actuator vibration at the main cavity edge by physically separating the mechanical actuator mount from the side wall.

In one embodiment the actuator is mounted rigidly at a diameter greater than that of the side-wall, with the main cavity being defined by a side-wall which approaches but does not touch the surface of the actuator. In such a configuration the radial acoustic wave in the main cavity is substantially reflected by the side-wall, creating the desired radial standing wave in the main cavity with pressure anti-node at the curved side-walls, but the actuator does not contact the side-wall, enabling it to vibrate with or closely with, an antinode of displacement at that radius, as desired. In further embodiments the side-wall is similarly defined, but with a compliant material filling the gap between the top of the side-wall and the surface of the actuator.

In a preferred embodiment, the use of an actuator whose active element is a ring of piezoelectric material to drive the oscillation of the actuator further overcomes the problems of limited piezoelectric material volume and high strain within the piezoelectric material. Because such a piezoelectric ring may be of significantly larger outer diameter than its piezoelectric disc counterpart it may have a significantly larger area. This enables a higher volume of piezoelectric material to be employed, and removes the piezoelectric material from the high-strain region at the centre of the actuator.

Preferably, a gap is provided between the top of the side wall and the first end wall. A layer of compliant material may be provided between the top of the side wall and the first end wall.

The secondary cavity may include a thinner portion between a rigid mount positioned radially outward of the side wall and the first end wall and a deeper portion radially outward of the side wall. The side wall may taper towards the first end wall.

The first end wall is preferably mounted on the radially outermost portion of the secondary cavity.

At least two apertures through the chamber walls are preferably provided, at least one of which is a valved aperture.

A second actuator may be provided such that, in use, the second actuator causes oscillatory motion of the second end wall in a direction substantially perpendicular to the second end wall.

One or both actuators may include an active element which is either piezoelectric or magnetostrictive and maybe a disc or a ring.

The active element is preferably excited in a radial mode to induce axial deflection of one or both of the end walls.

Preferably the distance between the inner and outer circumferences of the active element is approximately one half of a wavelength of the actuator mode-shape. In such a case the active element is preferably designed such that its inner and outer circumferences are located substantially at nodes of the actuator vibrational mode-shape, i.e. the actuator material substantially spans the area between such two nodes of vibration.

The distance between the inner and outer circumferences of the active element may be approximately one quarter of a wavelength of the actuator mode-shape. In such a case the active element is preferably designed such that its outer diameter is substantially adjacent the radially outermost portion of the secondary chamber.

In an alternative configuration, the actuator may include a solenoid.

The thickness of the first end wall is preferably shaped to optimise the actuator displacement profile for mode-shape matching.

The actuator is preferably constructed such that the piezoelectric or magnetostrictive material is pre-compressed in the actuator rest position.

The main cavity radius, a, and height h, preferably satisfy the following inequalities:

a/h is greater than 1.2; and $h^2/a$ is greater than $4\times10^{-10}$ m.

The main cavity radius, a, also preferably satisfies the following inequality:

$$\frac{k_0 \cdot \text{c_min}}{2\pi f} < a < \frac{k_0 \cdot \text{c_max}}{2\pi f},$$

where c_min is 115 m/s, c_max is 1970 m/s, f is the operating frequency and $k_0$ is a constant ($k_0$=3.83).

The motion of the driven end wall(s) and the pressure oscillations in the main cavity are preferably mode-shape matched and the frequency of the oscillatory motion may be within 20% of the lowest resonant frequency of radial pressure oscillations in the main cavity.

The ratio $$\frac{a}{h}$$

may be greater than 20. The volume of the main cavity may be less than 10 ml.

The frequency of the oscillatory motion is preferably equal to the lowest resonant frequency of radial pressure oscillations in the main cavity.

The lowest resonant frequency of radial fluid pressure oscillations in the main cavity is preferably greater than 500 Hz.

One or both of the end walls may have a frusto-conical shape such that the end walls are separated by a minimum distance at the centre and by a maximum distance at the edge.

The end wall motion is preferably mode-shape matched to the pressure oscillation in the main cavity.

The amplitude of end wall motion preferably approximates the form of a Bessel function.

It is preferable that any unvalved apertures in the chamber walls are located at a distance of 0.63a plus or minus 0.2a from the centre of the main cavity, where a is the main cavity radius.

It is preferable that any valved apertures in the chamber walls are located near the centre of the end walls.

The ratio $$\frac{h^2}{a}$$

is preferably greater than $10^{-7}$ meters and the working fluid is preferably a gas.

BRIEF DESCRIPTION OF THE DRAWINGS

Examples of the present invention will now be described with reference to the accompanying drawings, in which.

DETAILED DESCRIPTION OF THE EMBODIMENTS

Figure 1:
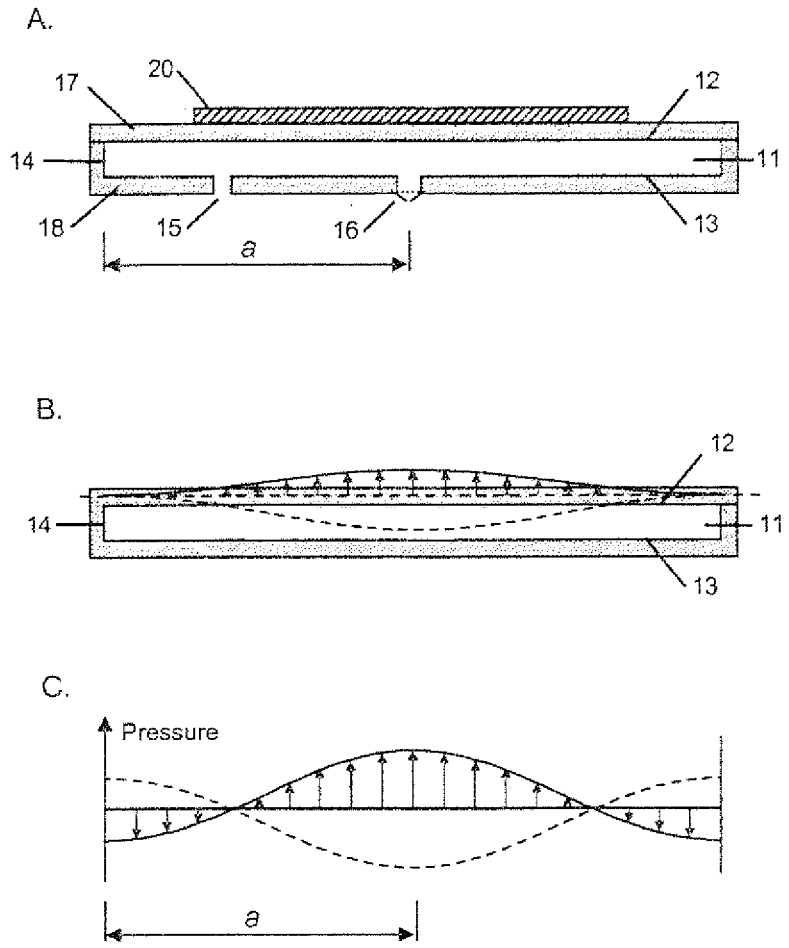
Figure 1 (Prior Art)
FIGS. 1A to C is a schematic representation of the pump according to the prior art in which the actuator displacement and pressure oscillation in the cavity are not mode-matched.

FIG. 1A is a schematic representation of the pump according to the prior art. A cavity 11 is defined by end walls 12 and 13, and a side wall 14. The cavity is substantially circular in shape, although elliptical and other shapes could be used. The cavity 11 is provided with a nodal air inlet 15, which in this example is unvalved. There is also a valved air outlet 16 located substantially at the centre of end wall 13. The first end-wall 12 is defined by the lower surface of a disc 17 attached to a main body 18. The inlet and outlet pass through the main body 18.

The actuator comprises a piezoelectric disc 20 attached to a disc 17. When an appropriate electrical drive is applied, the actuator is caused to vibrate in a direction substantially perpendicular to the plane of the cavity, thereby generating radial pressure oscillations within the fluid in the cavity.

FIG. 1B shows one possible displacement profile of the driven wall 12 of the cavity. In this case the amplitude of motion is maximum at the centre of the cavity, and minimum at its edge. The solid curved line and arrows indicate the wall displacement at one point in time, and the dashed curved line its position one half cycle later. The displacements as drawn are exaggerated, and the piezoelectric disc is omitted from the drawing for clarity.

FIG. 10 shows one possible pressure oscillation profile for the cavity shown in FIGS. 1A and 1B. The solid curved line and arrows indicate the pressure at one point in time, and the dashed curved line the pressure one half-cycle later. For this mode and higher-order modes there is an anti-node of pressure at the cavity wall. The radial dependence of the pressure in the cavity is approximately a Bessel function having the following characteristics:

$$P(r) = P_0 J_0\left(\frac{k_o r}{a}\right);\ k_0 \approx 3.83 \qquad \text{Equation 1}$$

where r is the radial distance from the centre of the cavity, a is the cavity radius, and $P_0$ is the pressure at the centre of the cavity.

FIGS. 1B and 10 show the modes of actuator displacement and pressure oscillation that are typically employed in the operation of the pump of FIG. 1A. It can be seen from inspection that the two modes are only moderately well matched in this case: where the actuator acts to enhance the pressure oscillation at the centre of the cavity it must necessarily act to decrease it near the cavity wall where the pressure oscillation is of the opposite sign.

The degree of mode-matching may be expressed by the product of the actuator velocity and pressure integrated over the area of the cavity. For example, where the actuator velocity and pressure may be represented by:

$$V(r,t)=V(r)\cdot\sin(\omega t)$$

$$P(r,t)=P(r)\cdot\sin(\omega t+\phi) \qquad \text{Equation 2}$$

where the function V(r) expresses the radial dependence of the actuator velocity, P(r) expresses the radial dependence of the pressure oscillation in the cavity, ω is angular velocity, t is time, and ϕ is the phase difference between the pressure and velocity. The degree of mode-matching may be defined by the integral of pressure and velocity over the surface of the actuator:

$$M = \frac{\int V(r)P(r)\cdot dA}{V(0)P(0)} \qquad \text{Equation 3}$$

where M represents the degree of mode-matching, V(0) and P(0) are respectively the actuator velocity and pressure at the centre of the cavity, dA is an element of area, and the integral is taken across the area of the actuator in direct communication with the cavity. In the design of FIG. 1 the amplitude of motion of the actuator is small close to the edge of the cavity and the central area of the actuator dominates this integral.

Figure 2:
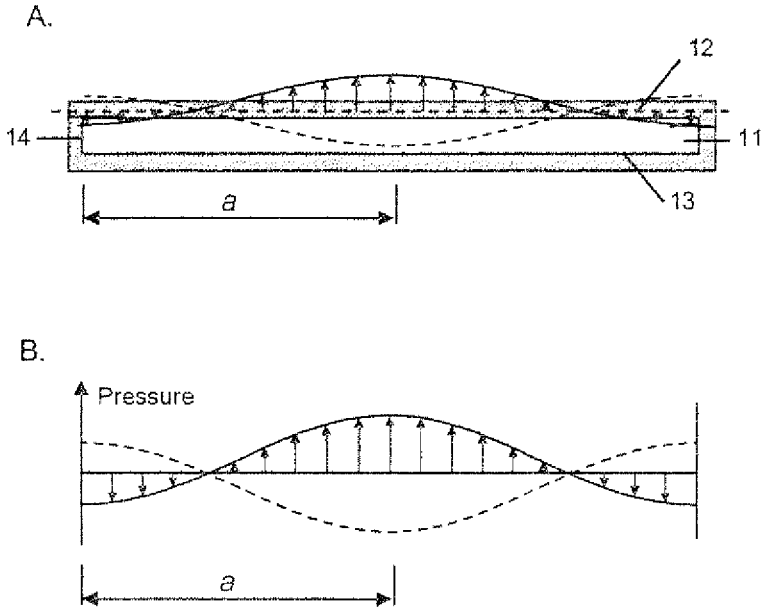
Figure 2 (Prior Art)
FIG. 2 is a schematic representation of a preferable embodiment according to the prior art in which the actuator displacement and pressure oscillation in the cavity are mode-matched.

FIG. 2 shows one possible preferable arrangement in which the actuator has a mode-shape which is well matched to the mode-shape of the pressure oscillation in the cavity. The actuator now acts to increase the amplitude of the pressure oscillation in the cavity at all points, and the degree of mode-matching as expressed by Equation 2 is increased. It should be noted that while the product of V(r) and P(r) is lower towards the cavity perimeter than it is at the cavity centre, the larger interaction area close to the cavity perimeter means that the cavity perimeter contributes significantly to the overall degree of mode-matching. The present invention concerns practical ways of achieving this preferential arrangement, i.e. achieving an antinode of actuator displacement at the cavity wall.

Figure 3:
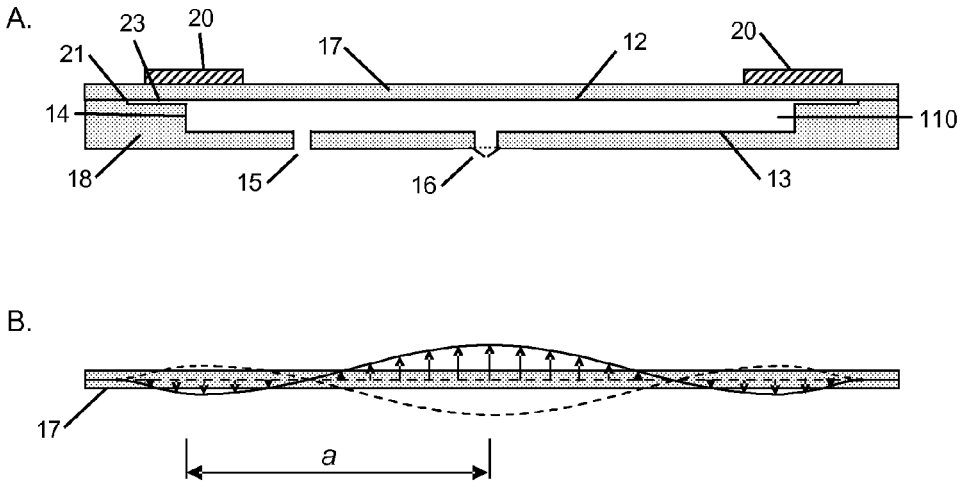
FIG. 3 illustrates one embodiment of the present invention, enabling the preferential mode-matched condition to be achieved.

FIG. 3A shows one possible embodiment of the present invention where the pump chamber is now divided into a main cavity 110 and a secondary cavity 23. In this design the actuator disc 17 is mounted to 18 around its perimeter. Mounting the actuator in this way enables a relatively rigid mount to be used, facilitating manufacture of the pump. The actuator is preferably driven in the vibrational mode shown in FIG. 3B. The side-wall 14 is formed by a step change in cavity depth at radius a, with the secondary cavity 23 extending beyond this radius at reduced depth to the radius at which the actuator is attached to the pump body 21. The step-change in cavity depth at the side-wall 14 acts to reflect the acoustic wave within the main cavity 110, generating the necessary standing wave, while the actuator motion remains unconstrained at this diameter, enabling the desired result of creating an anti-node of actuator vibration at the effective edge of the main cavity 110. The degree of reflection at the side-wall 14 of FIG. 3A depends primarily on two factors: the acoustic impedance of the side-wall material, and the height of the side-wall 14 relative to the depth of the main cavity 110. To a first approximation, the reflection coefficient, R, of a full-height main cavity wall is given by:

$$R = \left(\frac{Z_{Wall} - Z_{Fluid}}{Z_{Wall} + Z_{Fluid}}\right)^2 \qquad \text{Equation 4}$$

where $Z_{Wall}$ is the acoustic impedance of the side-wall material and $Z_{Fluid}$ is the acoustic impedance of the fluid in the main cavity 110. In order to achieve a strong main cavity resonance it is therefore important that the acoustic impedance of the wall material is either significantly larger or significantly smaller than that of the fluid in the main cavity. The former condition may be readily satisfied where the wall is made of metal or some plastics and the fluid in the main cavity is a gas, however other combinations are possible.

Where the side-wall does not extend to the full height of the main cavity, the degree of reflection will be reduced. To a first approximation, the reflection coefficient in this case will be given by:

$$R_{Effective} = R\frac{h_{Wall}}{h_{Cavity}} \quad \text{Equation 5}$$

where $h_{Wall}$ is the height of the side-wall, and $h_{Cavity}$ the height of the main cavity. It is therefore important that the height of the side-wall be maximised for the design shown in FIG. 3A.

Figure 4:
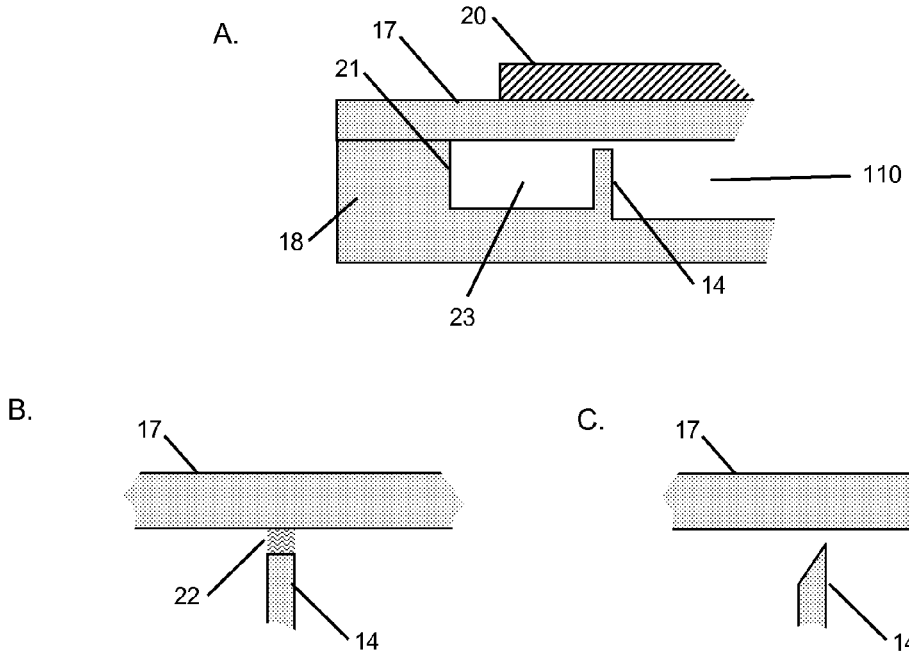
FIGS. 4A to C illustrates further embodiments of the present invention.

FIGS. 4A to 4C show variations of the present invention. FIG. 4A shows a pump in which the secondary cavity has an increased depth outside the side-wall 14. This design feature is intended to minimise the extent of the narrow gap between the top of the side-wall 14 and the actuator disc 17 as high pressures may be generated in this gap leading to a loss of pump efficiency. For this reason it is preferable that the side-wall 14 of FIG. 4A should be as narrow as reasonably possible while maintaining its acoustic impedance and thus its reflection coefficient. A tapered side-wall 14 may be preferable, an example of which is shown in FIG. 4C. In order to achieve optimal acoustic reflection at the inside edge of such a side-wall, it is preferable that the inside edge of the side-wall remains vertical as shown. FIG. 4B shows a pump in which a suitably compliant member fills the gap between the top of the side-wall 14 and the actuator disc 17. Such complaint member acts to further improve the reflection of acoustic energy at the side-wall. The stiffness of the compliant member must be carefully chosen to avoid significant damping of the actuator motion.

Figure 5:
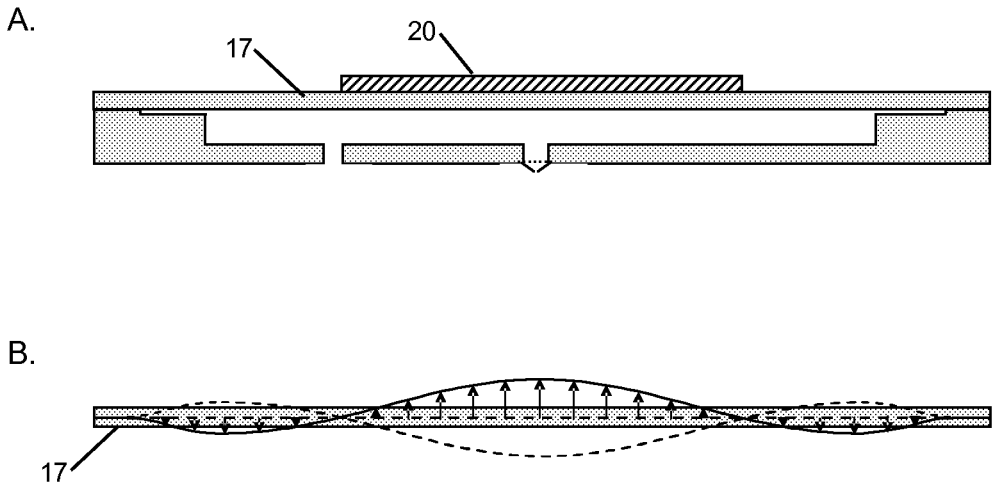
FIGS. 5 and 6 illustrate possible actuator constructions which may be employed in the present invention.

FIG. 5 shows one possible actuator design that may be employed in the present invention and which embodies a piezoelectric disc 20. For optimal operation the radius of this disc should be approximately equal to the radius of the first vibrational node of the actuator and therefore, for a mode-matched pump design, the radius of the piezoelectric disc should be approximately equal to the radius of the first node of the pressure oscillation in the main cavity. Beyond this first vibration node of the actuator the sign of the actuator curvature changes: the in-plane expansion of the piezoelectric disc that generates the curvature of the central actuator antinode region acts against generating the required curvature (now of the opposite sign) beyond the first vibrational node. As a general rule, a simple unimorph actuator of this type should be configured such that the piezoelectric element spans only areas in which the actuator curvature is of a single sign.

Figure 6:
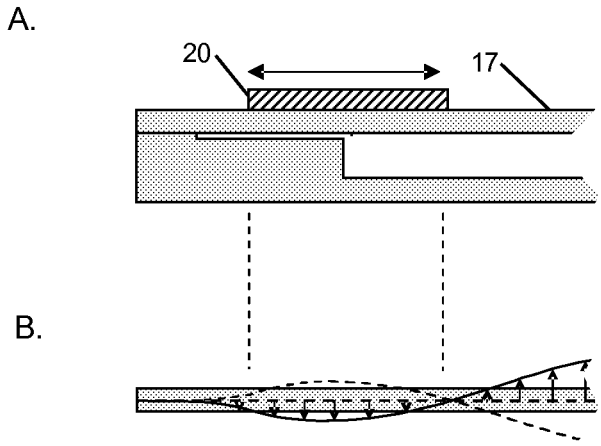

FIG. 6 shows a second possible actuator design that may be employed in the present invention. FIG. 6A shows the approximate radial positioning of a piezoelectric ring 20 on the disc 17. FIG. 6B shows the resulting displacement profile of the actuator with the piezoelectric ring omitted from the drawing for clarity. In this arrangement the PZT spans approximately one half-wavelength of the actuator's vibrational mode-shape, in which region the curvature of the actuator is again of one sign. As a result the in-plane expansion and contraction of the piezoelectric ring (indicated by the double-headed arrow) efficiently drives the vibration of the actuator.

The embodiment of FIG. 6 is preferable to that of FIG. 5 as the volume of piezoelectric material and therefore the maximum power output of the actuator are both higher. For example if the pump is mode-matched then the radial dependence of the actuator motion will match the radial dependence of the pressure oscillation in the main cavity and will therefore approximate the Bessel function of Equation 1. The piezo disc of FIG. 5A may therefore extend to a radius of approximately 0.63a, this being the radius of the first zero of the Bessel function that has its first maximum at the main cavity radius, a. The maximum useful area of such a piezoelectric disc is therefore approximately $1.2a^2$.

Again assuming a Bessel function dependence, the piezoelectric ring of FIG. 6 may extend from a radius of 0.63a to a radius of 1.44a (the next Bessel function zero), in which region the curvature of the Bessel function is again of a single sign. The maximum useful area of such a piezoelectric ring is therefore approximately $5.3a^2$. The actuator motion may only approximate a Bessel function, however this simple calculation illustrates the significant advantage of moving to a ring actuator in terms of the area of piezoelectric material and therefore the maximum power output of the actuator.

Figure 7:
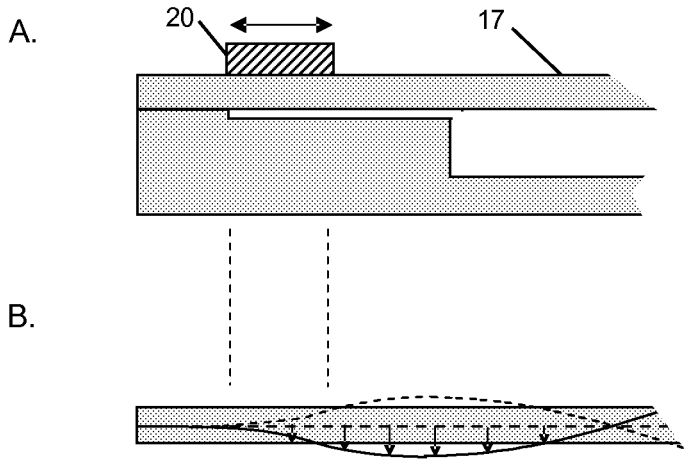
FIG. 7 shows one further possible actuator design that may be employed in the present invention.

FIG. 7 shows one further possible actuator design that may be employed in the present invention. FIG. 7A shows the approximate radial positioning of the piezoelectric ring 20 on the disc 17. FIG. 7B shows the resulting displacement profile of the actuator with the piezoelectric ring omitted from the drawing for clarity. In this arrangement the PZT spans approximately one quarter-wavelength of the actuator's vibrational mode-shape, in which region the curvature of the actuator is again of one sign. As a result the in-plane expansion and contraction of the piezoelectric ring (indicated by the double-headed arrow) efficiently drives the vibration of the actuator.

Figure 8:
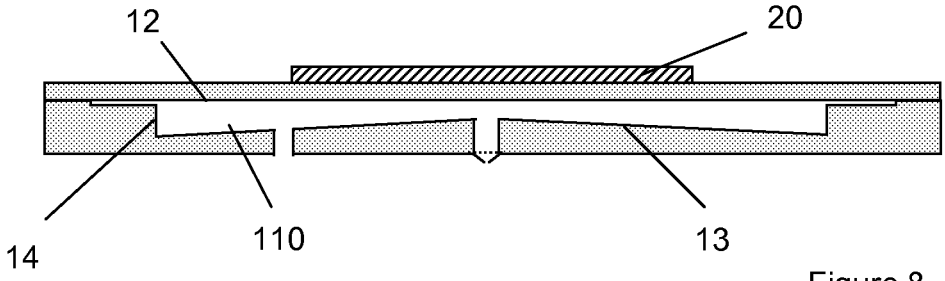
FIG. 8 illustrates a tapered main cavity.

FIG. 8 illustrates a tapered main cavity in which one end wall, in this case the second end wall, is frusto-conical in shape. It will be seen how the main cavity 110 has a greater height at the side-wall 14, whereas at the centre, the distance between the end walls 12, 13 is at a minimum. Such a shape provides an increased pressure at the centre of the cavity. Typically, the diameter of the cavity is 20 mm and the height at the centre is 0.25 mm and the height at the radial extreme is 0.5 mm.

The invention claimed is:

1. A fluid pump comprising:

a chamber which, in use, contains a fluid to be pumped, the chamber including a main cavity having a substantially cylindrical shape bounded by first and second end walls and a side wall and a secondary cavity extending radially outwards of the main cavity;

one or more actuators which, in use, cause oscillatory motion of the first end wall in a direction substantially perpendicular to the plane of the first end wall, the actuator including an active element which is either a piezoelectric ring or a magnetostrictive ring, the active element being excited in a radial mode to induce axial deflection of one or both of the end walls, the distance between the inner and outer circumferences of the ring being approximately one quarter of a wavelength of the actuator mode-shape; and whereby, in use, the axial oscillations of the first end wall drives radial oscillations of the fluid pressure in the main cavity; and wherein the secondary cavity spaces the side wall from the first end wall such that the first end wall can move relative to the side wall when the actuator is activated.

2. A fluid pump according to claim 1, wherein a gap is provided between the top of the side wall and the first end wall.

3. A pump according to claim 2, wherein a layer of compliant material is provided between the top of the side wall and the first end wall.

4. A pump according to claim 1, wherein the secondary cavity includes a thinner portion between the side wall and the first end wall and a deeper portion radially outward of the side wall.

5. A pump according to claim 4, wherein the side wall tapers towards the first end wall.

6. A pump according to claim 1, wherein the first end wall is mounted on the radially outermost portion of the secondary cavity.

7. A pump according to claim 1, further comprising at least two apertures through the chamber walls, at least one of which is a valved aperture.

8. A pump according to claim 7, wherein any valved apertures in the chamber walls are located near the centre of the main cavity.

9. A pump according to claim 7, wherein any unvalved apertures in the chamber walls are located at a distance of 0.63a plus or minus 0.2a from the centre of the main cavity, where a is the main cavity radius.

10. A pump according to claim 1, further comprising a second actuator, wherein, in use, the second actuator causes oscillatory motion of the second end wall in a direction substantially perpendicular to the second end wall.

11. A pump according to claim 1, wherein the outer circumference of the ring is substantially adjacent the radially outermost portion of the secondary cavity.

12. A pump according to claim 1, wherein the thickness of the first end wall is shaped to optimise the actuator displacement profile for mode-shape matching.

13. A pump according to claim 1, wherein the main cavity radius, a, and height h, satisfy the following inequalities:

a/h is greater than 1.2; and $h^2/a$ is greater than $4\times10^{-10}$ m and wherein the main cavity radius, a, also satisfies the following inequality:

$$\frac{k_0 \cdot c_min}{2\pi f} < a < \frac{k_0 \cdot c_max}{2\pi f},$$

where c_min is 115 m/s, c_max is 1970 m/s, f is the operating frequency and $k_0$ is a constant ($k_0$=3.83).

14. A pump according to claim 13, wherein the ratio $$\frac{a}{h}$$

is greater than 20.

15. A pump according to claim 13, wherein the volume of the main cavity is less than 10 ml.

16. A pump according to claim 13, wherein the ratio $$\frac{h^2}{a}$$

is greater than $10^{-7}$ meters and the working fluid is a gas.

17. A pump according to claim 13, wherein, in use, the motion of the driven end wall(s) and the pressure oscillations in the main cavity are mode-shape matched and the frequency of the oscillatory motion is within 20% of the lowest resonant frequency of radial pressure oscillations in the main cavity.

18. A pump according to claim 17, wherein the amplitude of end wall motion approximates the form of a Bessel function.

19. A pump according to claim 17, wherein, in use, the frequency of the oscillatory motion is equal to the lowest resonant frequency of radial pressure oscillations in the main cavity and this frequency is greater than 500 Hz.

20. A pump according to claim 1, wherein one or both of the end walls have a frusto-conical shape such that the end was are separated by a minimum distance at the centre and by a maximum distance at the edge.

21. A fluid pump comprising:

a chamber which, in use, contains a fluid to be pumped, the chamber including a main cavity having a substantially cylindrical shape bounded by first and second end walls and a side wall and a secondary cavity extending radially outwards of the main cavity;

one or more actuators which, in use, cause oscillatory motion of the first end wall in a direction substantially perpendicular to the plane of the first end wall, the actuator including an active element which is either a piezoelectric ring or a magnetostrictive ring, the active element being excited in a radial mode to induce axial deflection of one or both of the end walls, the radial distance between the inner and outer circumferences of the active element ring being approximately one half of a wavelength of the actuator mode-shape; and whereby, in use, the axial oscillations of the first end wall drives radial oscillations of the fluid pressure in the main cavity; and wherein the secondary cavity spaces the side wall from the first end wall such that the first end wall can move relative to the side wall when the actuator is activated.

22. A pump according to claim 21, wherein the inner and outer circumferences of the active element ring are located substantially at nodes of the actuator vibrational mode-shape.

23. A pump according to claim 21, wherein the actuator is constructed such that the piezoelectric or magnetostrictive material is pre-compressed in the actuator rest position.

* * * * *